United States Patent [19]

Ozawa

[11] 4,031,497

[45] June 21, 1977

[54] FUSIBLE RESISTOR

[76] Inventor: Juichiro Ozawa, c/o Susumu Industrial Co., Ltd. No. 14, Umamawashi-cho, Kamitoba, Minami, Kyoto, Japan

[22] Filed: Jan. 13, 1976

[21] Appl. No.: 648,804

[30] Foreign Application Priority Data

Sept. 23, 1975 Japan ..... 50-115411

[52] U.S. Cl. ..... 338/308; 337/297; 338/334

[51] Int. Cl.[2] ..... H01C 7/00

[58] Field of Search ..... 337/157, 163, 296, 297; 338/308, 309, 334

[56] References Cited

UNITED STATES PATENTS

| | | | |
|---|---|---|---|
| 3,143,615 | 8/1964 | Kozacka | 337/296 |
| 3,836,883 | 9/1974 | Takayasu et al. | 337/163 |
| 3,887,893 | 6/1975 | Brandt et al. | 337/296 |
| 3,978,443 | 10/1974 | Dennis et al. | 338/334 |

FOREIGN PATENTS OR APPLICATIONS

| | | | |
|---|---|---|---|
| 1,461,371 | 11/1966 | France | 338/308 |

*Primary Examiner*—William H. Beha, Jr.
*Attorney, Agent, or Firm*—Wenderoth, Lind & Ponack

[57] ABSTRACT

A fusible resistor device is made up of an elongated resistor film, a portion of which is disposed on a film of an organic substance attached to a base plate. The organic film is adapted to be melted by an excessive current flowing through the circuit including the elongated resistor film, whereby the organic film will decay to thereby open the circuit. The organic film is preferably produced by the polymerization of a monomer by a glow discharge within a gas atmosphere of the monomer.

2 Claims, 4 Drawing Figures

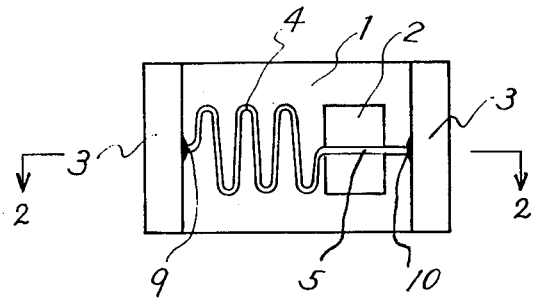
Fig. 1
Fig. 2
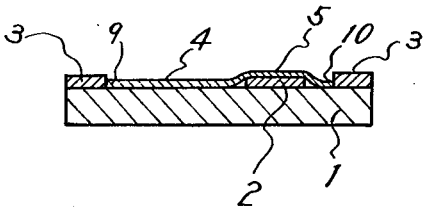
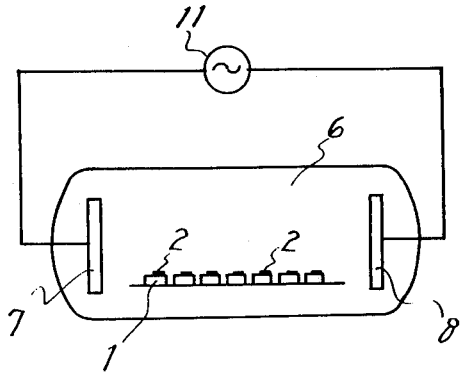
Fig. 3
Fig. 4
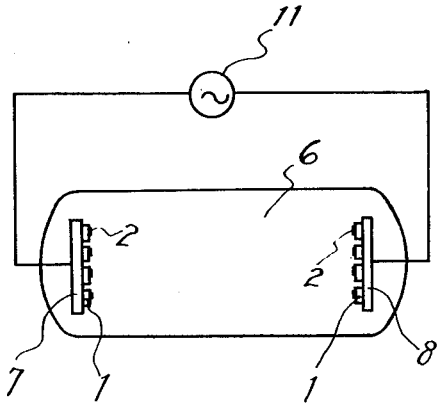

FUSIBLE RESISTOR

This invention relates to a fusible resistor device useful for protection against fire which might break out from over-loading of an electric machine or apparatus due to misoperation or abnormal operation thereof.

BACKGROUND OF INVENTION AND PRIOR ART

In recent years, many varieties of electronic apparatuses have come into use in homes and the like, and their design for protection against fire has assumed great social importance. Similarly, the industrial apparatuses such as electronic computer, telephone switching systems and the like have become larger year after year, and, accordingly, if a fire breaks out in such an apparatus, the whole of the valuable system could be greatly damaged.

Fusible resistors, which are generally utilized for protection against fire in the types of apparatus as described above, function as ordinary resistors for a normal current flow, but if a circuit should carry any abnormal excess current, a predetermined portion of the resistor in that circuit would be fused to open the circuit, whereby the apparatus is protected against overheating and possible fire.

A resistor usable in the manner described above should satisfy the following requirements:

1. It should function with a reliability equal to that of common resistors, and without danger of causing faulty operation of the apparatus with which it is used;

2. When a current in excess of a predetermined amount flows, it will be fused as quickly and surely as possible to open the circuit; 3. The fusible resistor, when being fused, will not produce an arcing discharge which itself might cause a combustion and produce smoke so as to cause a secondary fire; and 4. The operating conditions at which fusion occurs, i.e. amount of current and duration thereof, are as stable and capable of being accurately determined as possible.

OBJECTS AND BRIEF SUMMARY OF THE INVENTION

It is the object of the present invention to provide a fusible resistor which meets all of these requirements.

The fusible resistor according to this invention is comprised of an elongated nichrome film, a portion of which is disposed on a film of an organic substance, and in which the organic film is melted by virtue of the heat generated by the excess current flowing through said resistor film so as to decay.

BRIEF DESCRIPTION OF THE DRAWINGS:

The invention will now be explained further in detail with reference to the accompanying drawing, wherein:

FIG. 1 is a plan view of the fusible resistor according to this invention; and

FIG. 2 is a section taken along line 2—2 of FIG. 1; and

FIGS. 3 and 4 are illustrative representations of the principle of manufacturing the resistor of FIGS. 1 and 2 by forming the organic film on the base plate by a glow discharge.

DETAILED DESCRIPTION OF THE INVENTION

The fusible resistor device of this invention is comprised of a ceramic base plate 1, such as alumina, upon which is disposed an organic film 2 such as plastic, and a resistor film 4 of a fusible resistor material connected between electrodes 3 attached to said base plate 1, a portion 5 of said resistor film 4 being positioned on said organic film 2.

If the current flowing through the resistor film 4 constituted as stated above is increased to an amount in excess of a certain limit, but insufficient to immediately fuse and evaporate the resistor film, the temperature of the resistor film 4 will rise quickly up to a level at which the organic film 2 supporting the resistor film 4 is softened so as to be fluidized, so that the portion 5 of the resistor film 4 is no longer supported and it will immediately rupture to open the circuit. If the current is increased to an amount greatly in excess of a certain limit, the resistor film 4 itself will fuse and evaporate at the same time the organic film melts, thus opening the circuit. The fusible character of such a fusible resistor device may be adjusted so as to be fusible at a precise current within a wide range of currents by suitably selecting the material, thickness and width of the organic film 2 as well as the width, thickness and pattern of the resistor film 4.

The following example will illustrate a practical embodiment of the invention.

On a ceramic base plate 1 of alumina having a size of 8.5mm × 5.5mm × 0.65mm thick is disposed a rectangular film 4.5 × 1mm of a high molecular weight organic material about 10,000A thick. This high molecular weight organic material film may be prepared in the manner shown in FIG. 3 in which the interior of a vacuum discharging tube 6, wherein is located the above described base plate 1 suitably masked, is filled with a low pressure gas atmosphere of the divinyl benzene monomer at a pressure of 0.5 Torr, which serves as the raw material for said high molecular organic material, and an A.C. voltage of 500V, 5KHz from power source 11 is impressed across the discharging electrodes 7 and 8 to produce a glow discharge plasma, whereby said monomer is polymerized by the energy of said plasma to form a high molecular weight organic film on said base 1.

Next, taking advantage of vacuum evaporation, an elongated nichrome film resistor 4 having a thickness of 600A and a width of 0.1mm is formed, and then copper is evaporated on both end edges of the base plate 1 to form a set of electrodes 3 to which the ends 9 and 10 of the film resistor 4 are connected. The portion 5 of nichrome resistor film 4 which lies on the high molecular weight organic film 2 is 4.5mm long.

The characteristics of the fusible resistor device prepared in the manner described above are as follows:

| | |
|---|---|
| Resistance | 3.6 KΩ ± 5% |
| Interrupting voltage | 160V ± 10V or less |
| Rated operating life | less than ± 1% (1000 hrs.) |
| Rated power | 1/4W at 30V |

The fusible resistor according to this invention having the construction described above has the characteristic features as follows.

1. Because the fusible portion has precise dimensions, the conditions under which it will fuse and interrupt the current flowing therein can be determined accurately.

2. Because the organic film is prepared by the polymerization of a monomer by a glow discharge within a low pressure gas atmosphere of the monomer, the thickness of the organic film can be precisely controlled, so that the interruption voltage is stable, in contrast to the prior art devices, wherein the organic film is manufactured from a plate or sheet of organic substance which is cut into the necessary form, or synthetic resin dissolved in a solvent is coated on the base plate to make such a film.

3. Designs can be made so that the devices will fuse at current values over a range much wider than ever.

4. The length *l* of the fusible portion may be a substantial length, so that any risk of reclosing can be excluded.

5. High current discharge or arcing will not take place during interruption of the current during fusing.

6. Interruption is achieved immediately or within 10 seconds of the flow of overload current.

Instead of the glow discharge plasma for preparing organic film 2 as shown in FIG. 3, there may be used a reaction system as shown in FIG. 4, wherein the base plates 1 are arranged on and attached to the discharging electrodes 7 and 8. The organic film 2 may also be formed by means of a gas phase growing process, an evaporaion process, or a coating process with similar effectiveness as that attained by glow discharge process.

What is claimed is:

1. A fusible resistor device comprising a base plate of a heat resistant material, a thin layer of an organic material which is caused to decay when heated and over at least a part of said base plate, and an elongated film of a fusible resistor material extending across said base plate, at least a part of said film lying on said layer of organic material, whereby when the resistor film is connected in a circuit and an excessive current flows through said film of resistor material in the case of a somewhat excess current the heat generated thereby melts the organic film and the resistor film is no longer supported and ruptures, thereby opening the circuit in which the resistor film is connected.

2. A fusible resistor device as claimed in claim 1 in which said thin layer of an organic material is formed by the polymerization of a monomer by producing a glow discharge in a gaseous atmosphere of the monomer.

* * * * *